US009789659B2

(12) United States Patent
Kitaura et al.

(10) Patent No.: US 9,789,659 B2
(45) Date of Patent: Oct. 17, 2017

(54) SLIDE LOCK APPARATUS FOR PRESS MACHINE

(71) Applicant: PASCAL ENGINEERING CORPORATION, Hyogo (JP)

(72) Inventors: Ichiro Kitaura, Hyogo (JP); Akitake Hashidate, Hyogo (JP); Seiji Kimura, Hyogo (JP)

(73) Assignee: Pascal Engineering Corporation, Hyogo (JP)

( * ) Notice: Subject to any disclaimer, the term of this patent is extended or adjusted under 35 U.S.C. 154(b) by 144 days.

(21) Appl. No.: 14/760,530

(22) PCT Filed: Feb. 8, 2013

(86) PCT No.: PCT/JP2013/053068
§ 371 (c)(1),
(2) Date: Jul. 13, 2015

(87) PCT Pub. No.: WO2014/122775
PCT Pub. Date: Aug. 14, 2014

(65) Prior Publication Data

US 2015/0336347 A1 Nov. 26, 2015

(51) Int. Cl.
*G05G 5/06* (2006.01)
*B30B 15/28* (2006.01)

(52) U.S. Cl.
CPC ..... *B30B 15/28* (2013.01); *B30B 15/287* (2013.01); *Y10T 74/20636* (2015.01)

(58) Field of Classification Search
CPC ..... B30B 15/28; B30B 15/287; B30B 15/288; Y10T 74/20636; G05G 5/06; G05G 5/14; G05G 5/20; G05G 5/24; G05G 2700/08
See application file for complete search history.

(56) References Cited

U.S. PATENT DOCUMENTS 2,185,551 A 1/1940 Glasner et al.
3,603,210 A * 9/1971 Florjancic ..... B29C 45/6771 425/149

(Continued)

FOREIGN PATENT DOCUMENTS

JP 51-123972 10/1976
JP 10264783 A * 10/1998 ..... B60T 1/005

(Continued)

*Primary Examiner* — Adam D Rogers
(74) *Attorney, Agent, or Firm* — Norris McLaughlin & Marcus, P.A.

(57) ABSTRACT

A slide lock apparatus for a press machine includes: a flange member fixed over the shaft member for driving the slide, and having a flange portion; an annular main member fixed to the main frame, and having an annular member facing the flange portion; a plurality of reception holes formed in the annular member; a plurality of pin members installed in the plurality of reception holes so as to be shiftable therein; a plurality of actuators for driving the plurality of pin members between retracted positions and advanced positions penetrating into admission holes in the flange portion; a first locking member for locking the plurality of pin members in retracted positions; a first drive device for rotationally driving the first locking member; a second locking member for locking the plurality of pin members in their advanced positions; and a second drive device for rotationally driving the second locking member.

12 Claims, 10 Drawing Sheets

(56) References Cited

U.S. PATENT DOCUMENTS

| | | | | | |
|---|---|---|---|---|---|
| 4,737,093 | A | * | 4/1988 | Hori | B29C 33/202 425/151 |
| 5,357,780 | A | | 10/1994 | Bradnstetter et al. | |
| 5,560,262 | A | * | 10/1996 | Orzech | B60N 2/0806 248/423 |
| 5,596,910 | A | * | 1/1997 | Bauer | B60N 2/0806 248/408 |
| 5,845,781 | A | | 12/1998 | Alico et al. | |

FOREIGN PATENT DOCUMENTS

| | | | | | |
|---|---|---|---|---|---|
| JP | 2005059065 | A | * | 3/2005 | B30B 15/287 |
| JP | 2007-245172 | | | 9/2007 | |
| JP | EP-2878438 | A1 | * | 6/2015 | B30B 15/287 |
| JP | WO-2016088194 | A1 | * | 6/2016 | B30B 15/28 |

* cited by examiner

SLIDE LOCK APPARATUS FOR PRESS MACHINE

TECHNICAL FIELD

The present invention relates to a slide lock apparatus for a press machine that is capable of stopping the slide of the press machine at a desired stopping position or at a position in the neighborhood thereof.

BACKGROUND OF THE INVENTION

Various types of slide lock apparatus have been implemented that lock a slide of a press machine with respect to the main body of the press machine when repairs are to be performed to the machine, repairs are to be performed to a die thereof, or exchange of the die is to be performed, and which prevent the slide from shifting downward.

The slide lock apparatus for a servo press disclosed in Patent Document #1 is a slide lock apparatus that is capable of locking, in any desired position, a large diameter helical gear that drives the slide to go up and down via an eccentric mechanism, by engaging engagement claws with the gear teeth of that gear.

With this slide lock apparatus, three locking units are provided spaced along the width direction of the teeth of the helical gear, engagement claws that can engage with valley portions between the gear teeth of the helical gear are provided at the lower sides of the locking units, and these engagement claws are driven forwards and backwards by hydraulic actuators that are provided within the locking units. When the slide is to be locked, the three locking units are driven simultaneously so that their engagement claws are driven toward their advanced positions, and so that at least one of the engagement claws is engaged in a valley position between two gear teeth; and then, by locking the engagement claw with a ball locking mechanism that includes a steel ball, the helical gear is put into a locked state, so that the slide is locked.

And a safety locking mechanism for a press is disclosed in Patent Document #2.

With this safety locking mechanism, a stationary member through which a shaft member of the press passes is fixed to the main frame, a plurality of reception holes are formed in the stationary member, and a plurality of locking pins are shiftably installed in the reception holes. A locked member that opposes the stationary member in the axial direction from the exterior is fixed to the shaft member, a plurality of recesses are formed as circular arcs in portions of the locked member near its outer circumference and receive the inner peripheral halves of the plurality of locking pins, and a plurality of tooth portions for locking that can receive and stop the locking pins are formed at the end portions of these recesses in the circumferential direction.

Compression springs that bias the plurality of locking pins towards their respective advanced positions are installed in the reception holes. And, when the plurality of locking pins are changed over to their advanced positions, each of some portion of the plurality of locking pins is inserted into one of the recesses, and thereafter, since tooth portions for locking are received and stopped at the end portions of the recesses, accordingly the locked member is locked by the plurality of locking pins so that it cannot rotate, and thereby the shaft member is locked so that it cannot rotate, so that the slide is locked.

In order to make it possible to cancel the locked state described above, an annular fluid pressure cylinder is provided at the opposite side of the stationary member from the locked member, with an annular piston of this fluid pressure cylinder opposing the external peripheral halves of all of the locking pins from the exterior in the axial direction.

When the shaft member and the slide are to be kept in the locked state, the annular piston is held in its retracted position; and, when the lock released state is to be maintained, the annular piston is driven to its advanced position, so that the external circumferential halves of all of the locking pints are pressed toward the reception holes by the annular piston, whereby all of the locking pins are pushed out of the recesses and changed over to their retracted positions, and this state is maintained.

Patent Document #1: JP Laid-Open Patent Publication 2007-245172.

Patent Document #2: U.S. Pat. No. 2,185,551.

SUMMARY OF THE INVENTION

With the slide lock apparatus of Patent Document #1, it is necessary to provide an attachment construction for solidly fixing the three locking units to the main frame of the press machine so that they are arranged in a space at the side of the helical gear, at its external periphery. Moreover, not only do the three locking units require a large space for installation, but the cost of production is high, since each of the locking units is a device that has a complicated construction and includes two oil chambers, two compression springs, a ball locking mechanism that includes a steel ball, and so on.

And since the construction of the safety locking mechanism for a press of Patent Document #2 is such that the locking pins are supported in the reception holes in a cantilevered manner during the locked state, accordingly this is disadvantageous from the viewpoint of ensuring the durability of the locking pins and the reception holes.

Moreover, the locking mechanism is not provided that locks the plurality of locking pins in their retracted positions or in their advanced positions. Due to this, if the pressure cylinder is erroneously operated due to a mistake by the operator or due to a fault of the control system or the like, then there is a danger that the safety locking mechanism may operate erroneously, so that the shaft member and the slide may be mistakenly changed over from the locked state to the unlocked state; or, conversely, that they may be mistakenly changed over from the unlocked state to the locked state.

The object of the present invention is to provide a slide lock apparatus for a press machine that is capable of locking a plurality of pin members in advanced positions and in retarded positions and whose reliability is excellent, to provide a slide lock apparatus for a press machine that is capable of implementing a locking function with a simple structure, and to provide a slide lock apparatus for a press machine that is beneficial from the point of view of ensuring the durability of the reception holes in which the pin members are received, and of the pin members.

The present invention presents a slide lock apparatus for a press machine that locks a shaft member that rotates together with raising and lowering operation of a slide that is supported on a main frame of the press machine, so that the shaft member cannot rotate, characterized by comprising: a flange member fixed over an exterior of the shaft member so as to be incapable of rotation with respect thereto, and having a flange portion that is parallel to a plane orthogonal to an axis of the shaft member; an annular main member fitted over the exterior of the shaft member and fixed to the main frame, and having an annular member that opposes the flange portion from a side of the main frame; a plurality of pin members, respectively shiftably installed in a plurality of reception holes that are formed in the annular member parallel to the axis; a plurality of actuators for respectively driving each of the plurality of pin members between a retracted position in which it is held in the reception hole and an advanced position in which a predetermined end side portion is advanced out from the reception hole; a plurality of introduction holes for introducing the predetermined end side portions of the plurality of pin members when the plurality of pin members are in their advanced positions, formed in the flange portion with setting spaces between them in a circumferential direction, and shaped as circular arcs in cross section with an arc length in the circumferential direction being greater than a diameter of the pin members; a plurality of locking engagement portions formed respectively at end portions of the plurality of pin members; an annular first locking member capable of locking the plurality of pin members in their retracted positions via a plurality of first locking portions that are capable of engaging and disengaging with the plurality of locking engagement portions of the plurality of pin members from the circumferential direction respectively, when the plurality of pin members are in their retracted positions; a first drive means capable of rotationally driving the annular first locking member around the axis between a locking position in which it locks the plurality of pin members in their retracted positions, and an unlocking position; an annular second locking member capable of locking the plurality of pin members in their advanced positions via a plurality of second locking portions that are capable of engaging and disengaging with the plurality of locking engagement portions of the plurality of pin members from the circumferential direction respectively, when the plurality of pin members are in their advanced positions; and a second drive means capable of rotationally driving the second locking member around the axis between a locking position in which it locks the plurality of pin members in their advanced positions, and an unlocking position.

Various additional structures may be employed with the present invention, as described below.

(1) There may be provided an auxiliary main member that opposes the flange portion from an opposite side to the plurality of reception holes and that is fixed to the main member, and a plurality of support holes that are formed in the auxiliary main member and into which end side parts of the plurality of pin members can be inserted; and the construction may be such that, when the pin members are shifted to their advanced positions, the end side parts of the pin members passed through the introduction holes are inserted into corresponding ones of the support holes.

(2) The first locking member may be disposed in a position adjacent to an end surface of the flange portion of the annular member.

(3) The second locking member may be disposed in a position adjacent to an end surface of the auxiliary main member on an opposite side thereof to the flange member.

(4) There may be provided a first detection means that detects whether a position of the first locking member is its locking position or its unlocking position, and a second detection means that detects whether a position of the second locking member is its locking position or its unlocking position.

(5) The actuators may be built as double acting type fluid pressure cylinders, respectively, and the pin members may be constituted by rod portions of piston rod members of the fluid pressure cylinders, respectively.

(6) In (5) above, the fluid pressure cylinders may include forward acting fluid chambers for advancing the piston members and backward acting fluid chambers for retracting the piston members; and the plurality of forward acting fluid chambers of the plurality of fluid pressure cylinders may be connected to a single common first port for fluid pressure supplying/venting, and the plurality of backward acting fluid chambers of the plurality of fluid pressure cylinders may be connected to a single common second port for fluid pressure supplying/venting.

(7) The first drive means may include at least one fluid pressure cylinder that drives the first locking member toward its unlocking position, and at least one tension spring that biases the first locking member towards its locking position.

(8) The second drive means may include at least one fluid pressure cylinder that drives the second locking member toward its unlocking position, and at least one tension spring that biases the second locking member towards its locking position.

(9) The first locking member may include: a first annular plate member parallel to a plane orthogonal to the axis; a plurality of through holes formed in the first annular plate member so as respectively to correspond to the plurality of pin members and having widths in the circumferential direction that are greater than the diameter of the pin members; and a plurality of first locking portions that are constituted by plate portions at the one ends in the circumferential direction of the plurality of through holes.

(10) The second locking member may include: a second annular plate member parallel to a plane orthogonal to the axis; a plurality of through holes formed in the second annular plate member so as respectively to correspond to the plurality of pin members and having widths in the circumferential direction that are greater than the diameter of the pin members; and a plurality of second locking portions that are constituted by plate portions at one ends in the circumferential direction of the plurality of through holes.

(11) The device may be structured so that, whatever a rotational phase of the shaft member may be, the predetermined end side portions of the plurality of pin members are capable of entering into the plurality of introduction holes when the plurality of pin members are in their the advanced positions.

According to the present invention, since the locking engagement portions are formed on the pin members, and the first locking member and the first drive means are provided, accordingly it is possible to hold the plurality of pin members in a locked state in their retracted positions. In a similar manner, since the second locking member and the second drive means are provided, accordingly it is possible to hold the plurality of pin members in a locked state in their advanced positions. Due to this, even if the plurality of actuators operate erroneously due to a mistake by the operator or due to a fault of the control system or the like, still the plurality of pin members are not changed over from their advanced positions to their retracted positions due to this erroneous operation, and neither are they changed over from their retracted positions to their advanced positions, so that the reliability of this device is excellent.

Furthermore since, with this structure, not only are the plurality of pin members locked in their retracted positions with the single first locking member, but also the plurality of pin members are locked in their advanced positions with the single second locking member, accordingly it is possible to simplify the construction for locking the plurality of pin members in their retracted positions and in their advanced positions.

Moreover, since the plurality of first locking portions of the first locking member engage and release with the locking engagement portions of the plurality of pin members from the circumferential direction, accordingly it is possible to furnish a locking function whose reliability is high. The same also holds for the second locking member.

Yet further, since the shaft member and the slide are locked according to the additional structure described in (1) above, accordingly, in the state in which the plurality of pin members are changed over to their advanced positions, this is beneficial from the point of view of ensuring the strength of the pin members and the durability of the reception holes and of the pin members, because it is possible to support each of the pin members at both its ends by the reception hole and by the support hole. For the operation and the beneficial effects provided by the additional structures described in (2) through (11) above, reference should be made to the description of the specific embodiments that follows.

DETAILED DESCRIPTION OF THE PREFERRED EMBODIMENTS

In the following, this description of embodiments will be explained on the basis of specific embodiments.

Embodiment 1

The slide lock apparatus for a press machine according to the present invention is a device that locks the slide of the press machine by locking a shaft member that rotates together with the raising and lowering operation of the slide, so that the shaft member cannot rotate.

Figure 1:
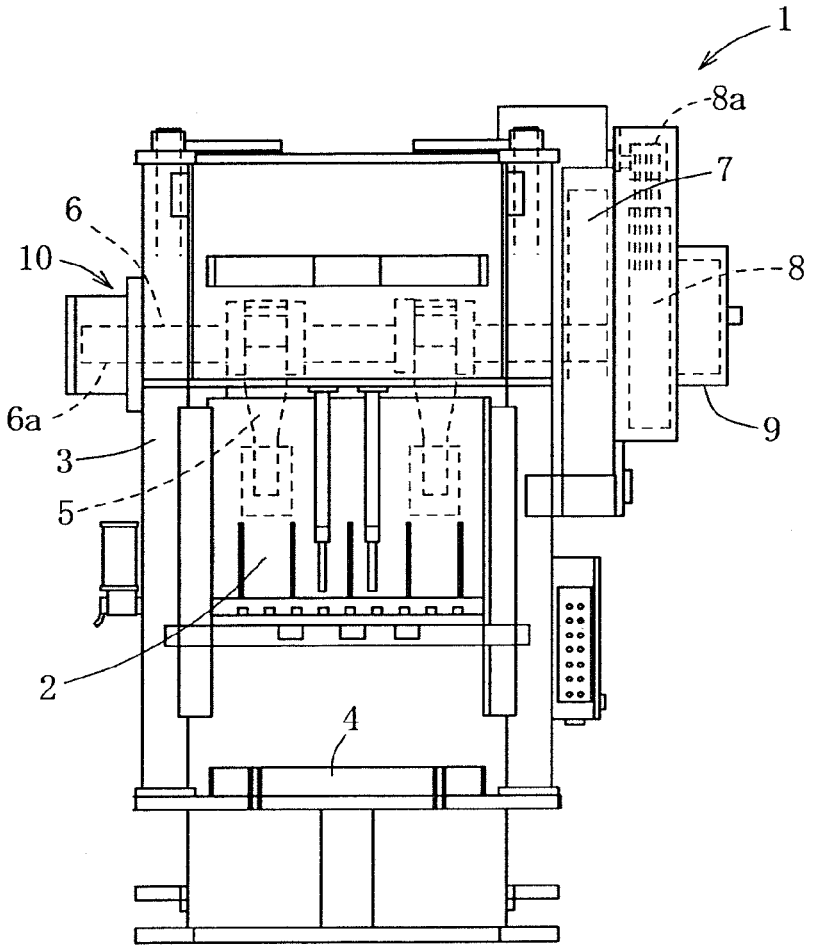
FIG. 1 is an elevation view of a press machine and a slide lock apparatus according to a first specific embodiment of the present invention.
Figure 2:
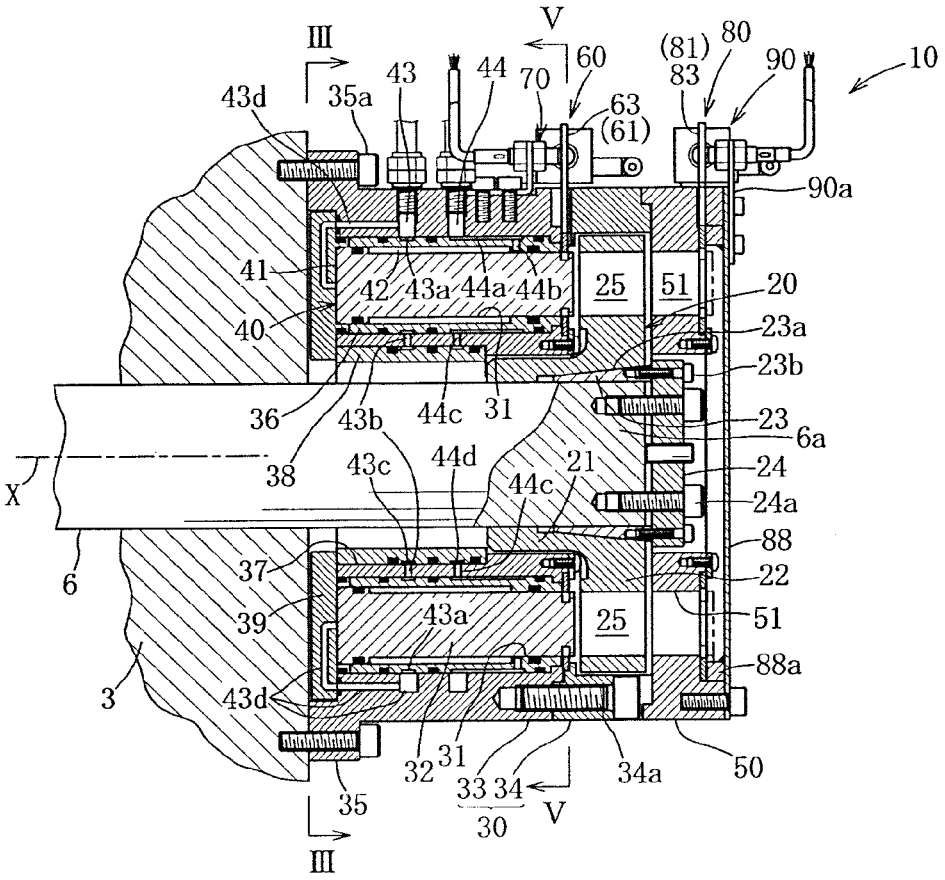
FIG. 2 is a vertical sectional view of the slide lock apparatus.
Figure 3:
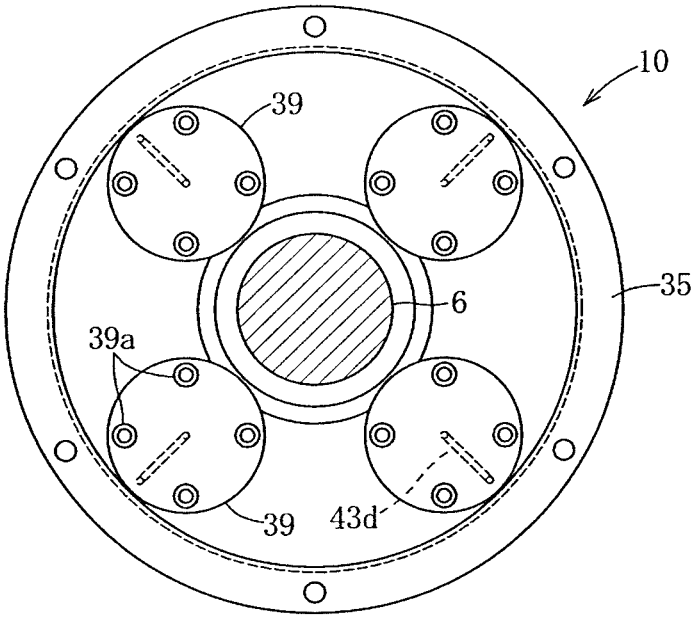
FIG. 3 is a sectional view taken along III-Ill line in FIG. 2.
Figure 4:
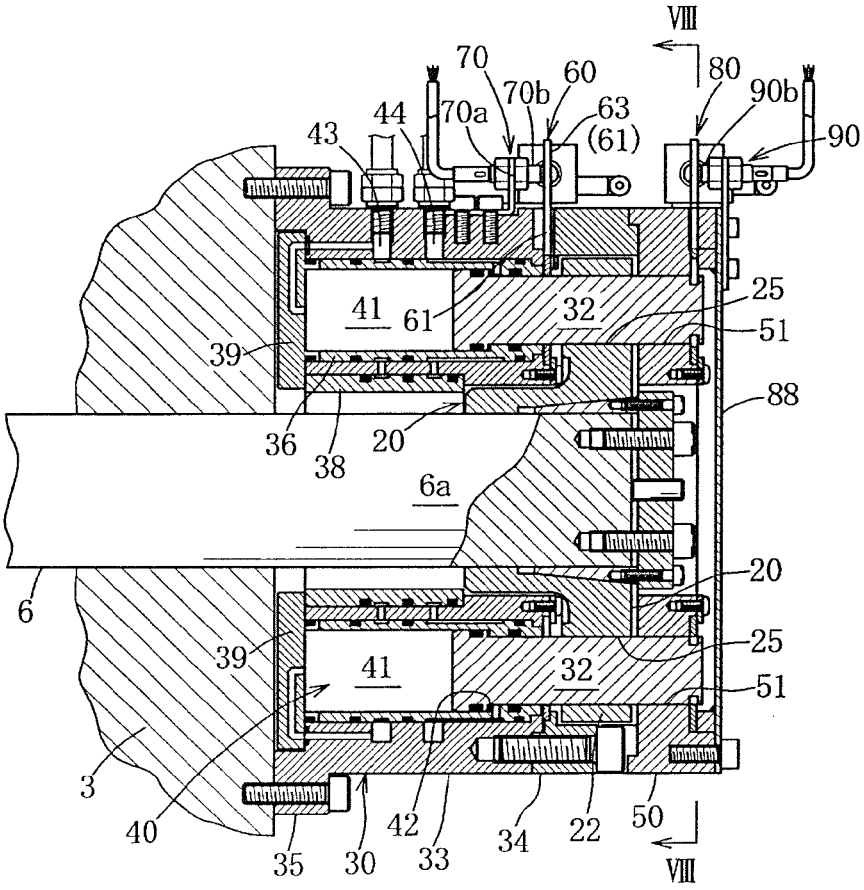
FIG. 4 is a vertical sectional view of the slide lock apparatus.

As shown in FIG. 1, a press machine 1 according to this specific embodiment is a typical crank press, and this press machine 1 comprises a main frame 3, a bolster 4, a slide 2 that is supported on the main frame 3 so as to be freely raised and lowered; a crankshaft 6 (i.e. "shaft member") that drives the slide 2 up and down via a pair of conrods 5; a main gear 7 that is fixed to the right end portion of the crankshaft 6; a flywheel 8 that is linked to the main gear 7 via gears (not shown); a clutch mechanism 9; an electric motor (not shown) that rotationally drives a pulley 8*a* which is linked to the flywheel 8; and so on. The slide lock apparatus 10 according to the present invention is attached to an axially elongated shaft portion 6*a* at the left end of the crankshaft 6, and also to the main frame 3.

This slide lock apparatus 10 will now be explained on the basis of FIGS. 2 through 9.

The slide lock apparatus 10 comprises a flange member 20, a main member 30, an auxiliary main member 50, a plurality of reception holes 31 and a plurality of pin members 32, a first locking means 60, a second locking means 80, and so on.

The above axially elongated shaft portion 6*a* projects outward from the outer surface of the left side of the main frame 3 by a certain length. And the flange member 20 is an annular member that is fixed over the outside of the axially elongated shaft portion 6*a* so as to be incapable of rotating with respect thereto. The flange member 20 comprises a tubular portion 21 that is fixed tightly over the outside of the end half portion of the axially elongated shaft portion 6*a* so as to be incapable of rotating with respect thereto, and an annular flange portion 22 that is formed integrally with the outer end portion of the tubular portion 21 in the axial direction, and that extends parallel to a plane that is orthogonal to the axis X of the shaft member 6. The thickness of the flange portion 22 in the axial direction is set to a predetermined thickness.

This flange member 20 is coupled to the axially elongated shaft portion 6*a* by a plurality of wedges 23 that are fitted tightly between a plurality of wedge shaped grooves 23*a* formed in the tubular portion 21 and the axially elongated shaft portion 6*a*, so that, along with being rotationally constrained so it cannot rotate relative to the shaft portion 6*a*, the flange member 20 also is not capable of shifting relative thereto in the direction of the axis X. The plurality of wedges 23 are attached by bolts 23*b* to a pressure plate 24 that is fixed to the end of the axially elongated shaft portion 6*a* by bolts 24*a*. Incidentally, it would also be possible to interpose a key between the axially elongated shaft portion 6*a* and the tubular portion 21.

Figure 8:
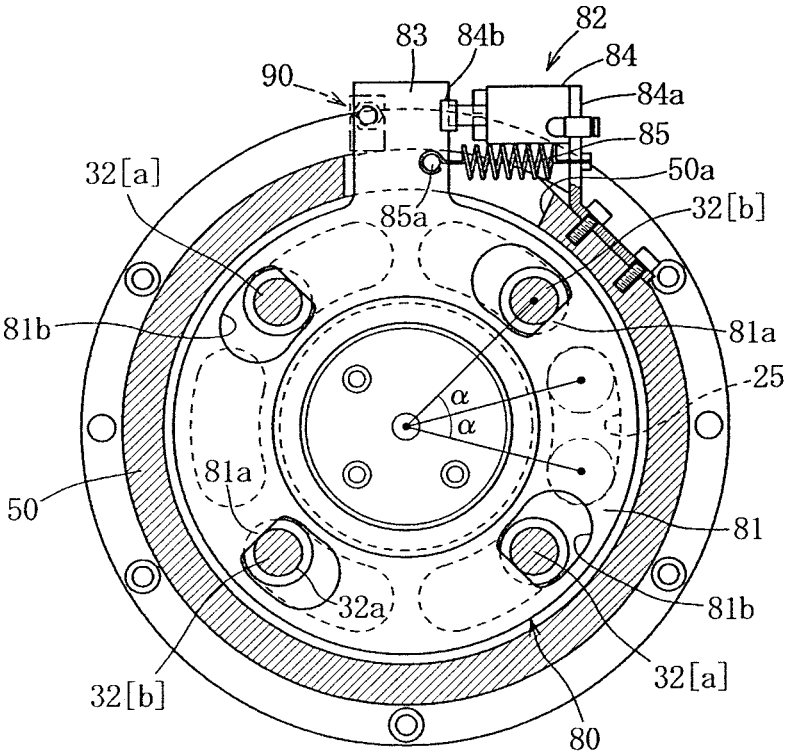
FIG. 8 is a sectional view taken along VIII-VIII line in FIG. 2.

As shown in FIG. 8, for example, six introduction holes 25 that pass through the flange portion 22 are formed in the shape of circular arcs. Predetermined end side portions of pin members 32 can be inserted into the introduction holes 25, and the extent of the introduction holes 25 in the circumferential direction is around 2.5 times the diameter of the pin members 32, with the angle $\alpha$ in FIG. 8 being, for example, 30°. When the four pin members 32 are changed over from retracted positions shown in FIG. 2 to advanced positions shown in FIG. 4, whatever the rotational phase of the shaft member 6 may be, among the four pin members 32, at least a pair of pin members 32 that are on opposite sides of the axis X enter into a pair of the introduction holes 25, and thereafter, as the shaft member 6 is rotated through only a small angle, the other pair of pin members 32 enter into another pair of the introduction holes 25. In this manner, each of the four pin members 32 is inserted into a corresponding one of four of the introduction holes 25.

The main member 30 comprises an annular member 33 that is fitted over the outside of the base end half of the axially elongated shaft portion 6*a* (i.e. base end on the side of the main frame 3) and over the tubular portion 21 and that is moreover fixed to the main frame 3, and a ring member 34 that is fixed to the end of the annular member 33. The annular member 33 is disposed more toward the main frame 3 than the flange portion 22, and moreover confronts the flange portion 22 with a gap of a few millimeters between them. The annular member 33 has an annular fixing flange 35 that is contacted against the outer surface of the main frame 3, and the main member 30 is fixed to the outer surface of the main frame 3 by the fixing flange 35 being attached to the main frame 3 by a plurality of bolts 35*a*. The ring member 34 is fixed by a plurality of bolts 34*a* to the end surface of the external peripheral portion of the annular member 33 (i.e. to its outer end surface), and surrounds the external periphery of the flange portion 22.

Four reception holes 31 that are parallel to the axis X are formed in the annular member 33 at positions dividing its periphery into four. The reception holes 31 are circular in cross section, and the pin members 32 are installed into the reception holes 31 so as to be able to shift freely therein in the direction parallel to the axis X. The reception holes 31 are formed in the interiors of tubular cylinder members 36 that are fixed in installation holes of the annular member 33. A sleeve shaped air passage forming member 38 is installed in a cylindrical hole 37 that is formed in the main member 30, radially inward of the four cylinder members 36. The base ends of the reception holes 31 and the cylinder members 36 are blocked by a circular lid member 39, and the lid member 39 is fixed to the annular member 33 by four bolts 39*a*.

The pin members 32 are built by rod portions of piston members, which are installed in the reception holes 31 so as to slide freely therein. Actuators 40 are provided that drive the pin members 32 between retracted positions as shown by solid lines in FIG. 2 and advanced positions shown by solid lines in FIG. 4, and these actuators 40 are built as double acting type air cylinders.

The auxiliary main member 50 is an annular member that opposes the flange portion 22 from the side opposite to the four reception holes 31, and that is fixed to the main member 30 by a plurality of bolts (not shown). Four support holes 51 that are circular in cross section are formed in the auxiliary main member 50, and correspond to the four reception holes 31. It should be understood that the number of the reception holes 31 and the number of the support holes 51 is not to be considered as being limited to being four; there could be three or fewer of them, or five or more.

When the pin members 32 are in their retracted positions, they are in the state of being received in the reception holes 31, and of being retracted towards the base ends thereof and withdrawn from the introduction holes 25. And, when the pin members 32 are in their advanced positions, they are in the state where predetermined end side portions of the pin members 32 (about half thereof) are advanced out from the reception holes 31 and enter into and through certain ones of the introduction holes 25, and then their end side parts are inserted into the corresponding support holes 51.

The actuators 40 comprise forward driving air chambers 41 and backward driving air chambers 42.

In the annular member 33, a single first air supply/vent port 43 is provided in common for the four forward driving air chambers 41 of the four actuators 40, and a single second air supply/vent port 44 is provided in common for their four backward driving air chambers 42. Each of the first and second air supply/vent ports 43, 44 is connected by an air passage (i.e. by a hose or a conduit) to a pressurized air source.

The first air supply/vent port 43 is communicated with each of the four forward driving air chambers 41 via annular air passages 43*a* formed in the cylinder members 36, air passages 43*b* formed in the main member 30, an annular air passage 43*c* formed in the air passage forming member 38, and air passages 43*d* that communicate these annular air passages 43*c* with the forward driving air chambers 41. And the second air supply/vent port 44 is communicated with each of the four backward driving air chambers 42 via sleeve shaped air passages 44*a* formed on the external circumferences of the cylinder members 36, air passages 44*b* formed in the cylinder members 36, air passages 44*c* formed in the main member 30, and an annular air passage 44*d* that are formed in the air passage forming member 38.

Due to this, when pressurized air is supplied to the first air supply/vent port 43 and accordingly pressurized air is supplied to the four forward driving air chambers 41, and pressurized air is vented from the four backward driving air chambers 42 to the second air supply/vent port 44, the four pin members 32 are shifted from their retracted positions to their advanced positions.

And, conversely to the above, when pressurized air is supplied to the second air supply/vent port 44 and accordingly pressurized air is supplied to the four backward driving air chambers 42, and pressurized air is vented from the four forward driving air chambers 41 to the first air supply/vent port 43, the four pin members 32 are shifted from their advanced positions to their retracted positions.

As described above when, in the state in which rotation of the shaft member 6 has been stopped, pressurized air is supplied to the first air supply/vent port 43 and pressurized air is discharged from the second air supply/vent port 44, predetermined end side portions of at least a pair of the pin members 32 on opposite sides of the first axis X penetrate into and through respective ones of the introduction holes 25, and their end side parts are then inserted into the corresponding pair of support holes 51. At this time, the ends of the remaining pair of pin members 32 are in the state of being contacted against the inner surface of the flange portion 22.

Thereafter, as shown in FIG. 8, when the shaft member 6 is slightly rotated in the forward rotational direction or in the reverse rotational direction due to the weight of the slide 2 or the like, predetermined end side portions of the pin members 32 that are contacted against the flange portion 22 penetrate into and through the corresponding ones of the introduction holes 25, and their end side parts are then inserted into their corresponding pair of support holes 51. When this state is established, the flange portion 22 (i.e. the flange member 20 and the shaft member 6) is restrained by the pair of pin members 32[*a*] so that it cannot rotate in the clockwise rotational direction in FIG. 8, and also the flange portion 22 (i.e. the flange member 20 and the shaft member 6) is restrained by the remaining pair of pin members 32[*b*] so that it cannot rotate in the anticlockwise rotational direction. As a result, the shaft member 6 is restrained so that it does not rotate, and it is thereby possible to lock the mechanism so that the slide 2 cannot be raised or lowered.

Next, the first and second locking means 60, 80 will be explained on the basis of FIG. 5 and FIG. 6.

The first locking means 60 is a system that locks the four pin members 32 in their retracted positions during operation of the press machine 1. Locking engagement portions 32*a* consisting of annular grooves are formed on the circumferences of the pin members 32 near their end portions. The first locking means 60 comprises an annular first locking member 61 shown in FIGS. 5 and 6, and a first drive means 62 that rotationally drives this first locking member 61 between a locking position and an unlocking position. The first locking member 61 (i.e. "first annular plate member") is a plate member that is parallel to a plane orthogonal to the axis X, and that is disposed at the end surface of the annular member 33 facing towards the flange portion 22 or in a position neighboring thereto, being rotatably installed in an annular gap that is defined between the annular member 33 and the ring member 34.

The first locking member 61 comprises four through holes 61*b* through which the four pin members 32 can pass, four first locking portions 61*a* consisting of plate portions at the one end portions of these through holes 61*b* (in FIG. 5, their end portions in the clockwise rotational direction), and an arm portion 63 that extends to the exterior from an arcuate opening portion 33*a* that is formed in the external circumferential side wall portion of the annular member 33. The width of the through holes 61*b* in the circumferential direction is set to be rather greater than the diameter of the pin members 32, and the width of the through holes 61*b* in the radial direction is set to be slightly greater than the diameter of the pin members 32.

The one ends of the through holes 61*b* are formed as straight line portions that are almost orthogonal to the circumferential direction around the axis X as center, and the first locking portions 61*a* that engage with the locking engagement groove portions 32*a* of the pin members 32 are constituted by the portions of the plate that include these straight line portions. The other ends of the through holes 61*b* are formed as semicircular arcs.

Figure 5:
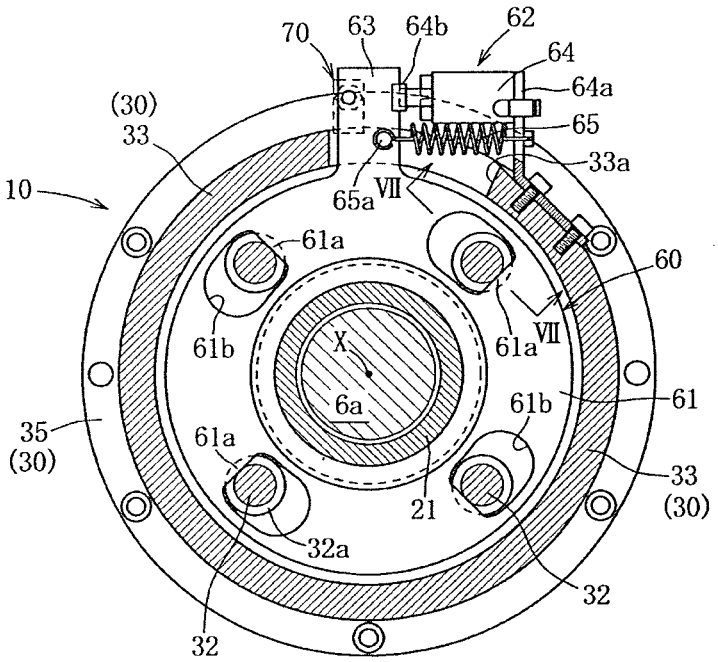
FIG. 5 is a sectional view taken along V-V line in FIG. 2.

In the state in which the four pin members 32 are held in their retracted positions, and the first locking member 61 is in its locking position shown in FIG. 5, the four first locking portions 61*a* are engaged into the corresponding locking engagement groove portions 32*a*, so that the pin members 32 become unable to shift in the direction along the X axis and are held in their retracted positions.

Figure 6:
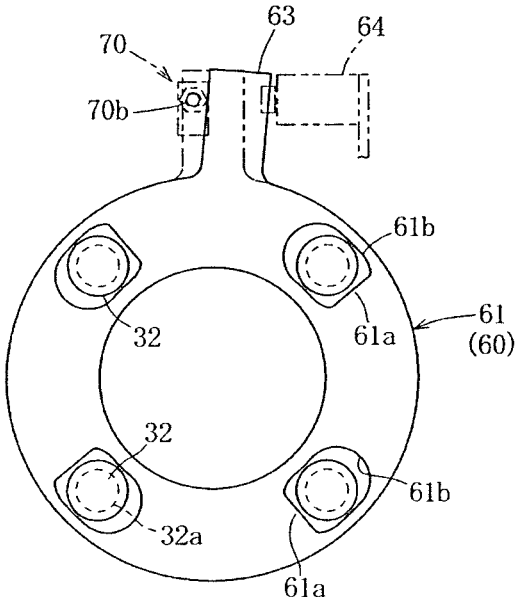
FIG. 6 is a side view of a first locking member, a first drive means, and a first detection means.
Figure 7:
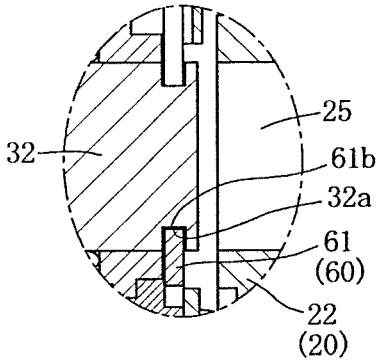
FIG. 7 is a sectional view taken along VII-VII line in FIG. 5.

The first drive means 62 comprises a first air cylinder 64 that is capable of rotating the arm portion 63 of the first locking member 61 in the anticlockwise rotational direction in FIG. 5, thus driving the first locking member 61 to its locking position, and a tension spring 65 that elastically biases the first locking member 61 toward its unlocking position shown in FIG. 6. The first air cylinder 64 is a single acting type spring return type cylinder, and is fixed to a bracket 64*a* that is fixed to the annular member 33 in the neighborhood of the opening portion 33*a*, with an engaging lug 64*b* at the end of its rod being engaged to the arm portion 63. This first air cylinder 64 is connected to an air supply hose (not shown) that extends from a pressurized air source. One end of the tension spring 65 is linked to a pin 65*a* that is fixed to the arm portion 63, while its other end is linked to the bracket 64*a*.

A first detection means 70 is provided that detects whether the first locking member 61 is positioned to its locking position or to its unlocking position (refer to FIG. 2 and FIGS. 4 through 6). For example, this first detection means 70 may be a proximity switch attached to a bracket 70*a* that is fixed to the outer peripheral surface of the annular member 33. This detection parts 70*b* confronts the arm portion 63, and its proximity switch is ON only when all of the pin members 32 are positioned in their retracted positions and moreover the first locking member 61 is in its locking position, while the proximity switch is OFF when the first locking member 61 is in its unlocking position (including any state in which any first locking portion 61*a* is contacted against any portion of the cylindrical outer peripheral surface of its pin member 32 other than its locking engagement groove portion 32*a*). It should be understood that, instead of a proximity switch, it would also be acceptable to employ a contact type detection switch or an optical type detection switch.

The second locking means 80 is a system that locks the four pin members 32 in their advanced positions when the press machine 1 is stopped and the slide 2 is to be held in a state in which it is prevented from being raised and lowered.

Figure 9:
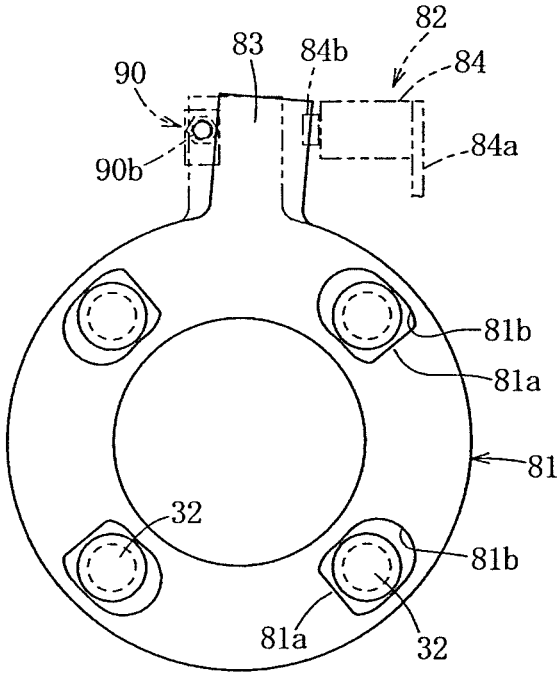
FIG. 9 is a side view of a second locking member, a second drive means, and a second detection means.

The second locking means 80 comprises an annular second locking member 81 shown in FIGS. 8 and 9, and a second drive means 82 that rotationally drives this second locking member 81 between a locking position and an unlocking position. The second locking member 81 (i.e. "second annular plate member") is a plate member that is parallel to a plane orthogonal to the axis X, and that is disposed at the end surface of the auxiliary main member 50 on the opposite side to the flange member 20 or in a position neighboring thereto, being rotatably installed between the auxiliary main member 50 and a ring member 88*a* that is adhered to a lid plate 88 fixed to the outer end surface of the auxiliary main member 50.

The second locking member 81 comprises four through holes 81*b* through which the four pin members 32 can pass, four second locking portions 81*a* consisting of plate portions at the one end portions of these through holes 81*b* (in FIG. 8, their end portions in the clockwise rotational direction), and an arm portion 83 that extends to the exterior from an arcuate opening portion 33*a* formed in the external circumferential side wall portion of the auxiliary main member 50. The width of the through holes 81*b* in the circumferential direction is set to be rather greater than the diameter of the pin members 32, and the width of the through holes 81*b* in the radial direction is set to be slightly greater than the diameter of the pin members 32.

The one ends of the through holes 81*b* are formed as straight line portions that are almost orthogonal to the circumferential direction around the axis X as center, and the second locking portions 81*a* that engage with the locking engagement portions 32*a* of the pin members 32 are constituted by the portions of the plate that include these straight line portions. The other ends of the through holes 81*b* are formed as semicircular arcs.

In the state in which the four pin members 32 are held in their advanced positions, and the second locking member 81 is in its locking position shown in FIG. 8, the four second locking portions 81*a* are engaged into the corresponding locking engagement groove portions 32*a*, so that the pin members 32 become unable to shift in the direction along the X axis and are held in their advanced positions.

The second drive means 82 comprises a second air cylinder 84 that is capable of rotating the arm portion 83 of the second locking member 81 in the anticlockwise rotational direction in FIG. 8, thus driving the second locking member 81 to its locking position, and a tension spring 85 that elastically biases the second locking member 81 toward its unlocking position shown in FIG. 9.

The second air cylinder 84 is a single acting type spring return type cylinder, and is fixed to a bracket 84*a* that is fixed to the auxiliary main member 50 in the neighborhood of its opening portion 50*a*, with an engaging lug 84*b* at the end of its rod being engaged to the arm portion 83. This second air cylinder 84 is connected to an air supply hose (not shown) that extends from a pressurized air source. One end of the tension spring 85 is linked to a pin 85*a* that is fixed to the arm portion 83, while its other end is linked to the bracket 84*a*.

A second detection means 90 is provided that detects whether the second locking member 81 is positioned to its locking position or to its unlocking position. For example, this second detection means 90 may be a proximity switch that is attached to a bracket 90*a* fixed so as to sandwich the lid plate 88 against the outer end surface of the auxiliary main member 50. The detection part 90*b* confronts the arm portion 83, and its proximity switch is ON only when the second locking member 81 is in its locking position, while the proximity switch is OFF when the second locking member 81 is in its unlocking position. By the way, instead of a proximity switch, it would also be acceptable to employ a contact type detection switch or an optical type detection switch.

Moreover it should be understood that, on the basis of detection of the signals from the first and second detection means 70, 90 and so on, the supply/vent of pressurized air to/from the first and second air supply/vent ports 43, 44 and the supply/vent of pressurized air to/from the first and second air cylinders 64, 84 is performed by a control unit (not shown) either via actuation by the operator, or without any operator intervention.

Next, the operation and the beneficial effects of this slide lock apparatus 1 will be explained.

During operation of the press machine 1, the four pin members 32 are kept in their retracted positions, and the first locking member 61 is kept in its locking position. Due to this, even if erroneous operation of the control system or erroneous operation of the actuators 40 takes place, the four pin members 32 are still kept in their retracted positions. Since the first locking member 61 is kept in its unlocking position by the biasing force of the tension spring 65, accordingly, even if it becomes impossible to supply pressurized air to the first air cylinders 64, the first locking member 61 is held in its unlocking position.

And, when the press machine 1 is stopped and repairs or exchanging of dies is to be performed, the four pin members 32 are held in their advanced positions, and the second locking member 81 is held in its locking position. Due to this, it becomes impossible for the shaft member 6 to rotate, and the slide 2 is locked so that it cannot lower. Since the second locking member 81 is held in its locking position, accordingly even if erroneous action by the operator, or a fault in the actuators 40, or erroneous operation of the actuators 40 takes place, the four pin members 32 are still kept in their advanced positions. And, since the second locking member 81 is held in its unlocking position by the biasing force of the tension spring 85, accordingly, even if it becomes impossible to supply pressurized air to the second air cylinders 84, the second locking member 81 is held in its unlocking position.

By forming the locking engagement groove portions 32*a* on the four pin members 32, by forming the first locking member 61 with the four first locking portions 61*a* which engage simultaneously with these four locking engagement groove portions 32*a*, and by driving the first locking member 61 to its locking position with the first drive means 62, and thereby providing a structure that locks the four pin members 32, the construction of the first locking means 60 becomes simple and easy. The same considerations as described above also hold for the second locking means 80.

Since the first and second locking means 60, 80 are principally constituted by the first and second locking members 61, 81, which are annular plate members that are parallel to a plane orthogonal to the axis of the mechanism, accordingly the structure becomes compact, and it is possible to anticipate that the slide lock apparatus 10 can be made more compact.

And, since the four first locking portions 61*a* of the first locking member 61 catch onto and release the locking engagement portions 32*a* of the four pin members 32 from the circumferential direction, which is a direction that is orthogonal to the axis X, accordingly it is possible to furnish a locking function whose reliability is high. The same considerations as described above also hold for the second locking member 81.

Moreover since, in order to lock the crankshaft 6 and the slide 2, in the state in which the four pin members 32 are changed over to their advanced positions, the pin members 32 can be supported at both ends of the introduction holes 25, both by the reception holes 31 and also by the support holes 51, accordingly this is advantageous from the viewpoint of the strength of the pin members 32, and is beneficial from the viewpoint of ensuring the durability of the reception holes 31 and of the pin members 32.

Yet further, since the first detection means 70 is provided that detects whether the position of the first locking member 61 is its locking position or its unlocking position, accordingly it is possible to detect that all of the pin members 32 have been locked in their retracted positions. Furthermore, it is also possible to detect that at least one of the pin members 32, or indeed every one of them, is not in its retracted position.

Even further, since the second detection means 90 is provided that detects whether the position of the second locking member 81 is its locking position or its unlocking position, accordingly, if the unlocking position is detected by the first detection means 70 and moreover the locking position is detected by the second detection means 90, it is possible to confirm that all of the pin members 32 are positioned to their advanced positions and moreover are in the locked state. However, a condition for this is that pressurized air is being supplied to the first air supply/vent port 43.

Still further, since the actuators 40 that drive the pin members 32 are built as double acting type air cylinders that are installed within the annular member 33, accordingly it is possible to simplify the structure of the actuators 40. Moreover, since the first and second air supply/vent ports 43, 44 supply or vent pressurized air to or from all the four actuators 40 together, accordingly it is possible to simplify the structure of the actuators 40.

Variant examples of this slide lock apparatus 10 will now be explained.

(1) The number of the reception holes 31, the support holes 51, and the pin members 32 is not to be considered as being limited to four; it could also be three or fewer, or five or more. Moreover, the number of the introduction holes 25 is not to be considered as being limited to six; it could also be five or fewer, or seven or more. The size of the introduction holes 25 in the circumferential direction could also be set as appropriate, according to the number of the introduction holes 25.

(2) The actuators 40 may be built as fluid pressure cylinders such as air cylinders or oil pressure cylinders or the like. In a similar manner, the first and second air cylinders 64, 84 may be built as fluid pressure cylinders such as air cylinders or oil pressure cylinders or the like, or as solenoid actuators.

(3) The first and second drive means 62, 82 could be built as double acting type fluid pressure cylinders, in which case the tension springs 65, 85 could also be omitted.

Figure 10:
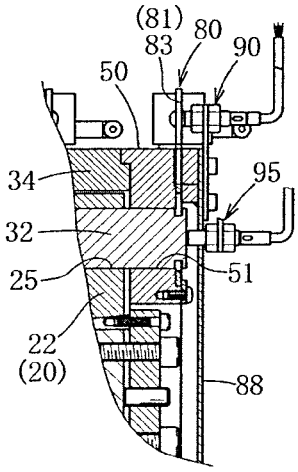
FIG. 10 is a sectional view of essential portions of a slide lock apparatus according to a variant embodiment.
Figure 11:
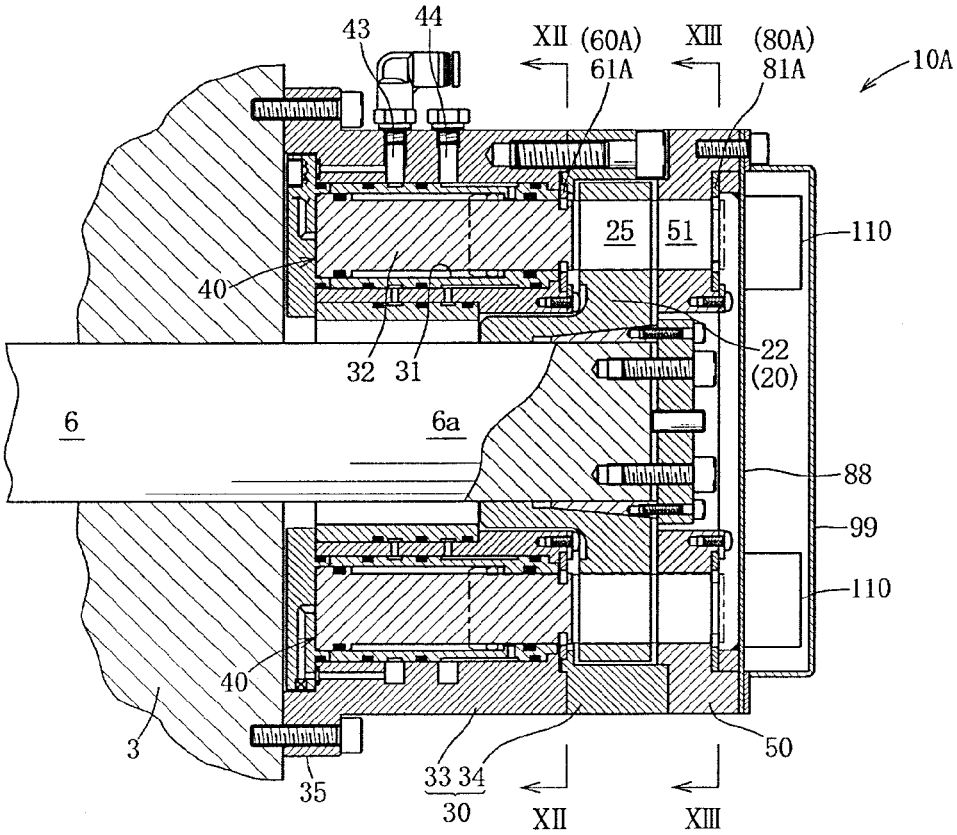
FIG. 11 is a vertical sectional view of a slide lock apparatus according to a second specific embodiment.

(4) As shown in FIG. 10, an arrangement could be implemented in which four proximity switches 95 corresponding to the four pin members 32 are provided to the lid member 88, in which case it would be possible reliably to detect that the four pin members 32 are positioned to their advanced positions.

Embodiment 2

Next, a slide lock apparatus 10A according to a second specific embodiment will be explained on the basis of FIGS. 11 through 15. However, since this slide lock apparatus 10A is the slide lock apparatus 10 described above, with only the first and second drive means 62, 82 of the first and second locking means 60, 80 and the first and second detection means 70, 90 altered, accordingly only the structures that are different will be explained, while the same reference symbols will be appended to elements that are generally similar and explanation thereof will be omitted.

Figure 12:
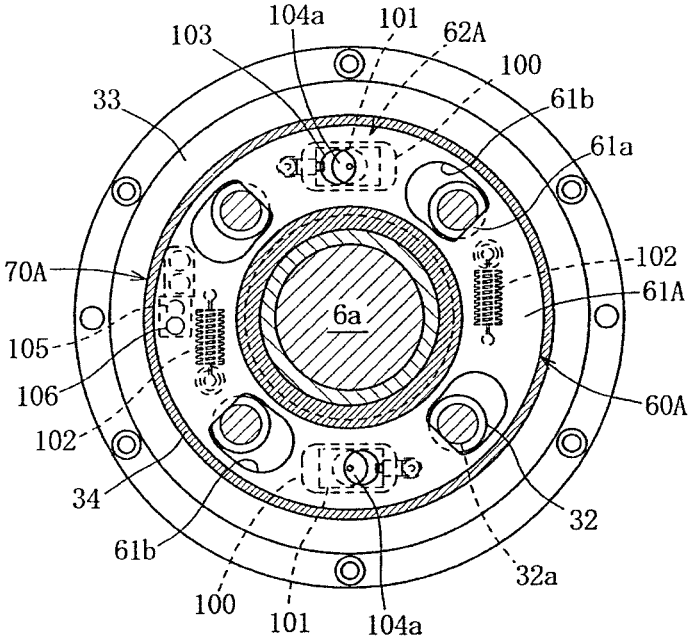
FIG. 12 is a sectional view taken along XII-XII line in FIG. 1I.
Figure 14:
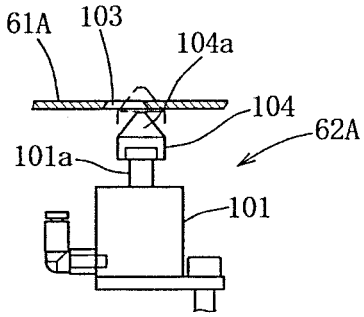
FIG. 14 is a sectional view of essential portions of a first drive means.

As shown in FIGS. 12 and 14, the first drive means 62A of the first locking means 60A comprises a pair of first air cylinders 101 disposed in a pair of cavity portions 100 formed in portions of the annular member 33 between pairs of the reception holes 31, a pair of tension springs 102 that drive the first locking member 61A to return to its locking position, and a pair of circular holes 103 formed in the first locking member 61A. The first air cylinders 101 are spring return type air cylinders whose axes extend parallel to the axis X, and comprise piston rods 101*a* at the ends of which cone members 104 comprising cone portions 104*a* are installed, with these cone portions 104*a* nosing into the circular holes 103.

The pair of tension springs 102 bias the first locking member 61A towards its locking position shown in FIG. 12 (i.e. in the anticlockwise rotational direction in FIG. 12), and, when the first locking member 61A is in this locking position, the cone portions 104*a* are retracted from the circular holes 103. And, when the first locking member 61A is to be changed over to its unlocking position, pressurized air is supplied to the first air cylinders 101 so that their piston rods 101*a* extend, the cone portions 104*a* are thrust into the circular holes 103, and the first locking member 61A is rotated slightly in the clockwise rotational direction in FIG. 12.

The first detection means 70A comprises a proximity switch that is disposed in a cavity portion formed in the annular member 33, and, when the first locking member 61A is in its locking position, the proximity switch is turned ON, since a detection part 105 thereof is removed away from a detection hole 106 formed in the first locking member 61A and opposes a plate portion of the first locking member 61A. By contrast, when the first locking member 61A is in its unlocking position, the proximity switch is turned OFF, since the detection part 105 of the proximity switch opposes the detection hole 106.

Figure 13:
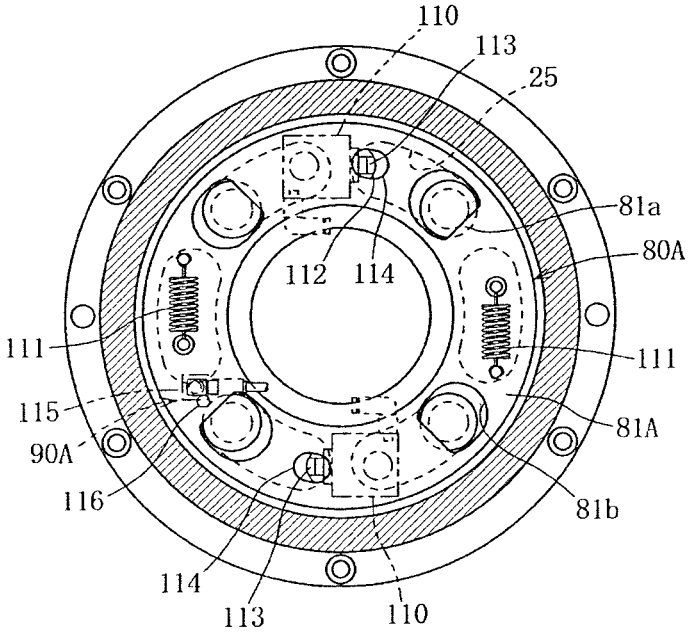
FIG. 13 is a sectional view taken along XIII-XIII line in FIG. 11.
Figure 15:
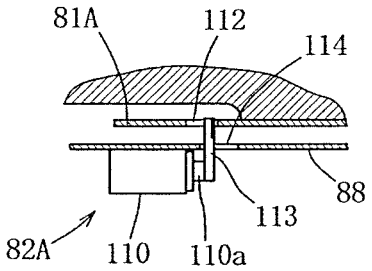
FIG. 15 is a sectional view of essential portions of a second drive means.

As shown in FIGS. 13 and 15, the second drive means 82A of the second locking means 80A comprises a pair of second air cylinders 110 that are fixed to the outer surface of the lid member 88, a pair of tension springs 111 that drive the second locking member 81A to return to its locking position, and a pair of circular holes 112 formed in the second locking member 81A. The second air cylinders 110 are spring return type air cylinders whose axes extend parallel to the second locking member 81A and moreover are arranged to face its circumferential direction. Arm members 113 are provided as adhered to the ends of piston rods 110*a* of the second air cylinders 110. The arm members 113 pass through apertures 114 formed in the lid member 88, and extend orthogonally to the second locking member 81A towards the second locking member 81A so as to be engaged into circular holes 112.

The pair of tension springs 111 bias the second locking member 81A towards its locking position shown in FIG. 13 (i.e. in the anticlockwise rotational direction in FIG. 13), and, when the second locking member 81A is in this locking position, as shown in FIG. 15, the arm members 113 contact against the edge portions of the circular holes 112 (in FIG. 13, its edge portions in the clockwise rotational direction). And, when the second locking member 81A is to be changed over to its unlocking position, pressurized air is supplied to the second air cylinders 110 so that their piston rods 110*a* extend, and, via the arm members 113, the second locking member 81A is slightly rotated in the locking release direction (in FIG. 13, in the clockwise rotational direction).

The second detection means 90A comprises a proximity switch that is fixed to the lid member 88, and, when the second locking member 81A is in its locking position, the proximity switch is turned ON, since a detection part 115 thereof is removed away from a detection hole 116 formed in the second locking member 61A and opposes a plate portion of the second locking member 81A. By contrast, when the second locking member 81A is in its unlocking position, the proximity switch is turned OFF, since the detection part 115 of the proximity switch opposes the detection hole 116. It should be understood that a cover member is fixed to the lid member 88 and covers over the exteriors of the second air cylinders 110 and the second detection means 90A.

Since it is possible to arrange the first and second drive means 62A, 82A and first and second detection means 70A, 90A more radially inward than the external circumferences of the first and second locking members 61A, 81A, and since they do not project out from the external circumferences of the main member 30 and the auxiliary main member 50, accordingly it is possible to anticipate making this slide lock apparatus more compact. The other features of the operation of this second embodiment and its beneficial effects are almost the same as in the case of the first specific embodiment, and accordingly explanation thereof will be omitted.

It should be understood that, for a person skilled in the art, it would be possible to implement the slide lock apparatus of the present invention by partially varying either the first or the second specific embodiment described above, within the range in which the scope of the present invention is not deviated from; and the present invention also includes all such partially varied examples.

INDUSTRIAL APPLICABILITY

The present invention provides a slide lock apparatus that, according to requirements, is capable of reliably locking the slide of a press machine.

The invention claimed is:

1. A slide lock apparatus for a press machine that locks a shaft member that rotates together with raising and lowering operation of a slide that is supported on a main frame of the press machine, so that the shaft member cannot rotate, comprising:

a flange member fixed over an exterior of the shaft member so as to be incapable of rotation with respect thereto, and having a flange portion that is parallel to a plane orthogonal to an axis of the shaft member;

an annular main member fitted over the exterior of the shaft member and fixed to the main frame, and having an annular member that opposes the flange portion from a side of the main frame;

a plurality of pin members, respectively shiftably installed in a plurality of reception holes that are formed in the annular member parallel to the axis of the shaft member;

a plurality of actuators for driving the plurality of pin members between a retracted position in which the plurality of pin members are held in the reception holes and an advanced position in which predetermined end side portions are advanced out from the plurality of reception holes;

a plurality of receiving holes receiving the predetermined end side portions of the plurality of pin members when the plurality of pin members are in their advanced positions, formed in the flange portion with setting spaces between them in a circumferential direction, and shaped as circular arcs in cross section with an arc length in the circumferential direction being greater than a diameter of the plurality of pin members;

a plurality of locking engagement portions formed respectively at end portions of the plurality of pin members;

an annular first locking member capable of locking the plurality of pin members in their retracted positions via a plurality of first locking portions that are capable of engaging and disengaging with the plurality of locking engagement portions of the plurality of pin members from the circumferential direction respectively, when the plurality of pin members are in their retracted positions;

a first drive means capable of rotationally driving the annular first locking member around the axis of the shaft member between a locking position in which the annular first looking member locks the plurality of pin members in their retracted positions, and an unlocking position;

an annular second locking member capable of locking the plurality of pin members in their advanced positions via a plurality of second locking portions that are capable of engaging and disengaging with the plurality of locking engagement portions of the plurality of pin members from the circumferential direction respectively, when the plurality of pin members are in their advanced positions; and a second drive means capable of rotationally driving the annular second locking member around the axis of the shaft member between a locking position in which the annular second locking member locks the plurality of pin members in their advanced positions, and an unlocking position.

2. A slide lock apparatus for a press machine according to claim 1, further comprising:

an auxiliary main member that opposes the flange portion from an opposite side to the plurality of reception holes and that is fixed to the annular main member, and a plurality of support holes that are formed in the auxiliary main member and into which end side parts of the plurality of pin members can be inserted; and wherein the auxiliary main member is so constructed that, when the pin members are shifted to their advanced positions, the end side parts of the pin members passed through the receiving holes are inserted into corresponding ones of the support holes.

3. A slide lock apparatus for a press machine according to claim 2, wherein the second locking member is disposed in a position adjacent to an end surface of the auxiliary main member on an opposite side thereof to the flange member.

4. A slide lock apparatus for a press machine according to claim 1, wherein the first locking member is disposed in a position adjacent to an end surface of the flange portion of the annular member.

5. A slide lock apparatus for a press machine according to claim 1, further comprising a first detection means that detects whether a position of the first locking member is its locking position or its unlocking position, and a second detection means that detects whether a position of the second locking member is its locking position or its unlocking position.

6. A slide lock apparatus for a press machine according to claim 1, wherein the actuators are built as double acting type fluid pressure cylinders, respectively, and the pin members are constituted by rod portions of piston rod members of the fluid pressure cylinders, respectively.

7. A slide lock apparatus for a press machine according to claim 6, wherein:

the fluid pressure cylinders comprise forward acting fluid chambers for advancing the piston members and backward acting fluid chambers for retracting the piston members; and the plurality of forward acting fluid chambers of the plurality of fluid pressure cylinders are connected to a single common first port for fluid pressure supplying/venting, and the plurality of backward acting fluid chambers of the plurality of fluid pressure cylinders are connected to a single common second port for fluid pressure supplying/venting.

8. A slide lock apparatus for a press machine according to claim 1, wherein the first drive means comprises at least one fluid pressure cylinder that drives the first locking member toward its unlocking position, and at least one tension spring that biases the first locking member towards its locking position.

9. A slide lock apparatus for a press machine according to claim 1, wherein the second drive means comprises at least one fluid pressure cylinder that drives the second locking member toward its unlocking position, and at least one tension spring that biases the second locking member towards its locking position.

10. A slide lock apparatus for a press machine according to claim 1, wherein the first locking member comprises: a first annular plate member parallel to a plane orthogonal to the axis of the shaft member; a plurality of through holes formed in the first annular plate member so as respectively to correspond to the plurality of pin members and having widths in the circumferential direction that are greater than the diameter of the pin members; and a plurality of first locking portions that are constituted by plate portions at one end in the circumferential direction of the plurality of through holes.

11. A slide lock apparatus for a press machine according to claim 1, wherein the second locking member comprises: a second annular plate member parallel to a plane orthogonal to the axis of the shaft member; a plurality of through holes formed in the second annular plate member so as respectively to correspond to the plurality of pin members and having widths in the circumferential direction that are greater than the diameter of the pin members; and a plurality of second locking portions that are constituted by plate portions at one end in the circumferential direction of the plurality of through holes.

12. A slide lock apparatus for a press machine according to claim 1, wherein the predetermined end side portions of the plurality of pin members are capable of entering into the plurality of receiving holes when the plurality of pin members are in their advanced positions and when the shaft member is in any rotational phase.

* * * * *